US005736468A

United States Patent [19]

Elgarhy

[11] Patent Number: 5,736,468

[45] Date of Patent: Apr. 7, 1998

[54] STAIN RESISTANT POLYAMIDE SUBSTRATE TREATED WITH SULFONATED PHOSPHATED RESOL RESIN

[75] Inventor: Yassin M. Elgarhy, Laval, Canada

[73] Assignee: Trichromatic Carpet Inc., St-Eustache, Canada

[21] Appl. No.: 786,214

[22] Filed: Jan. 21, 1997

Related U.S. Application Data

[63] Continuation-in-part of Ser. No. 728,779, Oct. 9, 1996, which is a continuation-in-part of Ser. No. 190,637, Feb. 2, 1994, abandoned.

[51] Int. Cl.[6] ..... B32B 27/30; B32B 27/34; B32B 27/42

[52] U.S. Cl. ..... 442/93; 8/495; 252/8.7; 252/8.75; 252/8.8; 427/385.5; 427/389.9; 427/393.4; 428/378; 428/395; 442/94; 442/168

[58] Field of Search ..... 8/495; 252/8.7, 252/8.75, 8.8; 428/96, 287, 288, 290, 375, 378, 395, 477.4; 427/385.5, 389.9, 393.4; 524/462, 463, 508, 509, 611; 525/136, 143; 442/93, 94, 168

[56] References Cited

U.S. PATENT DOCUMENTS

| | | | |
|---|---|---|---|
| 4,501,591 | 2/1985 | Ucci et al. | 8/495 |
| 4,592,940 | 6/1986 | Blyth et al. | 428/96 |
| 4,680,212 | 7/1987 | Blyth et al. | 428/97 |
| 4,780,099 | 10/1988 | Greschler et al. | 8/115.6 |
| 4,822,373 | 4/1989 | Olson et al. | 8/115.6 |
| 5,279,614 | 1/1994 | Uchida et al. | 8/115.51 |
| 5,328,766 | 7/1994 | Smith | 428/378 |
| 5,356,689 | 10/1994 | Pechhold | 428/96 |

*Primary Examiner*—D. S. Nakarani
*Attorney, Agent, or Firm*—Swabey Ogilvy Renault

[57] ABSTRACT

A treated fibrous polyamide substrate having durable resistance to staining by acid colorants comprising a fibrous polyamide substrate having applied thereto an aqueous solution of a sulfonated, phosphated resol resin and a methacrylic polymer or copolymer of high number average molecular weight, and preferably high weight average molecular weight and optionally, fluorochemical; and the method of treating said substrate with the solution to render it durable to staining by acid colorants.

20 Claims, No Drawings

STAIN RESISTANT POLYAMIDE SUBSTRATE TREATED WITH SULFONATED PHOSPHATED RESOL RESIN

CROSS-REFERENCE TO RELATED APPLICATION

This application is a Continuation-in-Part of Ser. No. 08/728,779, filed Oct. 9, 1996, now pending, which is a Continuation-in-Part of Ser. No. 08/190,637, filed Feb. 2, 1994, now abandoned.

BACKGROUND OF THE INVENTION a) Field of the Invention

This invention relates to a fibrous polyamide substrate having durable resistance to staining by acid colorants and to a method of rendering a fibrous polyamide substrate durably resistant to staining by acid colorants.

b) Description of Prior Art

Fibrous polyamide substrates, such as nylon carpeting are susceptible to staining by both naturally occurring and commercial acid colorants found in many common foods and beverages. The demand for reduced staining from such acid colorants has by and large been met by treatment with compositions comprising sulfonated naphthol and/or sulfonated phenol-formaldehyde condensation products as disclosed, for example, in the following patents: U.S. Pat. No. 4,501,591 (Ucci and Blyth); No. 4,592,940 (Blyth and Ucci); No. 4,680,212 (Blyth and Ucci); and No. 4,780,099 (Greschler, Malone and Zinnato); or by treatment with compositions comprising sulfonated novolak resins together with polymethacrylic acid as disclosed in U.S. Pat. No. 4,822,373 (Olson, Chang and Muggli). The use of polymers or copolymers of methacrylic acid of low weight average molecular weight and low number average molecular weight is described in U.S. Pat. No. 4,937,123 (Chang, Olson and Muggli).

The initial stain resistant properties imparted to polyamide substrates, such as carpeting, that have been treated using the above mentioned compositions degenerates significantly with each wet cleaning the substrate receives. Improved stain resistance after wet cleaning can be achieved by increasing the amount of stain-resist product initially applied to the substrate. However, this generally leads to discoloration caused by yellowing of the substrate initially, and further discoloration results following exposure to oxides of nitrogen and/or light. This discoloration in most cases is attributed to dihydroxydiphenyl sulfone and its associated $SO_2$ group.

Stain-resist products currently available in the market place are generally novolak-type resins based on dihydroxydiphenyl sulfone condensed with phenol sulfonic acid or naphthalene sulfonic acid and an aldehyde in various proportions. The chemical structure of these resins may generally be depicted as follows:

(a) Condensation product of naphthalene sulfonic acid and dihydroxydiphenyl sulfone with formaldehyde

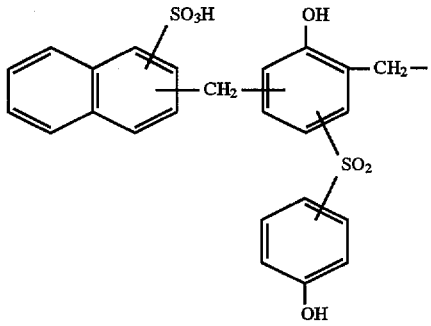

(b) Condensation product of phenolsulfonic acid and dihydroxydiphenol sulfone with formaldehyde

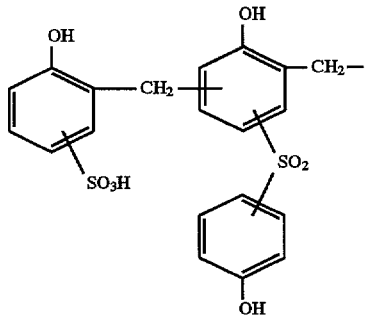

It is generally known that increasing the ratio of dihydroxydiphenol sulfone to phenol sulfonic acid or naphthalene sulfonic acid will increase the stain resist properties of the resin and subsequently cause a higher degree of yellowing or discoloration initially and further discoloration upon exposure to oxides of nitrogen and/or light. It is also evident that when the ratio of phenol sulfonic acid or naphthalene sulfonic acid to dihydroxydiphenyl sulfone is increased, the result is lowered stain-resist properties and less discoloration.

The addition of acrylic polymers and/or copolymers to the previously mentioned condensation products, as disclosed in U.S. Pat. No. 4,822,373 (Olson, Chang and Muggli), allows the use of a novolak resin condensate containing a high ratio of dihydroxydiphenol sulfone without adverse discoloration. This is achieved due to the dramatically reduced percentage of novolak resin in the product which is adjusted to obtain a desired maximum level of discoloration while maintaining a minimum level of durable stain resistance. The high level of initial stain resistance is supplied primarily by the acrylic polymers and/or copolymers and, after wet cleaning stain resistance is maintained by the novolak resin condensate, the acrylics having largely been removed during the wet cleaning process.

SUMMARY OF THE INVENTION

It is an object of this invention to provide fibrous polyamide substrates having durable resistance to staining by acid colorants.

It is a further object of this invention to provide a method of rendering a fibrous polyamide substrate durably resistant to staining by acid colorants.

It is a particular object of the invention to provide such a substrate or method in which a treating solution is employed which contains a polymer or copolymer of methacrylic acid of high weight average and number average molecular weight.

In accordance with one aspect of the invention there is provided a fibrous polyamide substrate having durable resistance to staining by acid colorants, the substrate having applied thereto a treating solution comprising a sulfonated, phosphated resol resin and a methacrylic polymer or copolymer having a number average molecular weight in the range of 20,000 to 40,000.

In accordance with another aspect of the invention there is provided the method of treating a fibrous polyamide substrate, to render it durably resistant to staining by acid colorants comprising: applying to the substrate material a solution comprising sulfonated, phosphates resol resin together with a methacrylic polymer or copolymer having a number average molecular weight in the range of 20,000 to 40,000..

DESCRIPTION OF PREFERRED EMBODIMENTS

The novel compositions developed according to the present invention, that is to say, the phosphated, sulfonated resol resins supplemented by a methacrylic polymer or copolymer and, optionally, a fluorochemical, when applied to fibrous polyamide substrates provide substrates that exhibit superlative resistance to staining by acid colorants, stain-resistant qualities that are not significantly impaired following repeated washing. It is to be noted too that the novel compositions according to the invention tend to minimize discoloration of the fibrous polyamide substrates both during manufacture and subsequently following exposure either to oxides of nitrogen or light.

The novel stain-blocking resin compositions according to the invention differ materially from stain-blockers of the prior art, many of which, as has been mentioned, rely on use of partially sulfonated novolak resins. The new resins are in fact resol resins heretofore unknown in the art, and are lighter in color than prior art novolak resins.

The series of reactions terminating in the preparation of the partially sulfonated and phosphated resins according to the invention runs as follows: condense phenol and sulfonated naphthalene in the presence of an aldehyde, preferably formaldehyde, in an alkaline medium, pH 9 to 10. Following the formaldehyde condensation the pH of the medium is adjusted to between 4 to 5, and a sulfonating agent such as sodium metabisulfite ($Na_2S_2O_5$) is added. The reaction leading to partial sulfonation of the phenol is continued for 1 to 2 hours at 105° C. The reaction mixture is then cooled to 50° C., phosphoric acid ($H_3PO_4$) is added, the temperature is raised to 90° to 105° C. and the phosphating reaction is continued for 1 to 2 hours.

The ratio of sulfonated naphthalene to phenol initially is between 0 and 40 percent, preferably 10 to 25 percent, by weight, sulfonated naphthalene to 75 to 90 percent phenol, by weight, while the ratio of formaldehyde should be at least one mole of phenol to one mole HCHO, and may be 1.3:1.

The sulfonated naphthalene employed at the initial stage of the reaction may be any one of three naphthalene derivatives, namely, either the 1-, 2- or 3-monosulfonic acid derivatives with the 2-monosulfonic derivative being preferred.

Sufficient $H_3PO_4$ is employed to assure between 1 and 15 percent, preferably 5 to 15%, more preferably 5 to 10% and especially 10% by weight phosphation. Following phosphation an alkaline solution is added to adjust the pH to between 5 and 6 and the solids content to between 30 and 40 percent, by weight, the alkali used being either sodium or potassium hydroxide.

The product is yellow to light brown in color, the color tending to darken on exposure to light or air, or to oxides of nitrogen, but color may be stabilized by the addition of a small amount of sodium formaldehyde-H-sulfoxylate, $NaHSO_2.HCHO.2H_2O$, at a pH below 7 and a temperature below 90° C. for 20 to 60 minutes, preferably 30 minutes, the quantity of the sulfoxylate being 0.1 to 4.0 percent, preferably 0.5 to 2.0 percent. The sulfoxylate treatment reduces color by 20 to 50 percent and prevents further discoloration.

The reaction scheme according to the invention may generally but without undue restriction be graphically illustrated as follows:

(1)

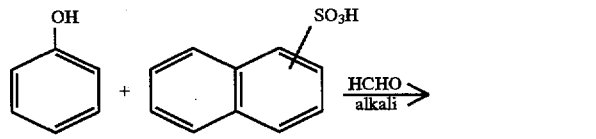

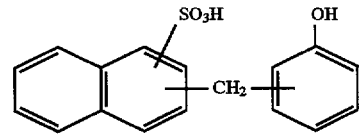

(2)

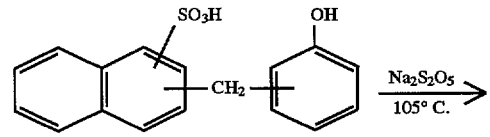

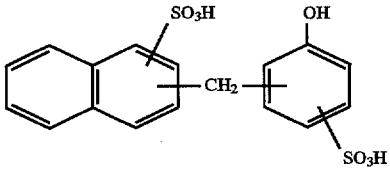

(3)

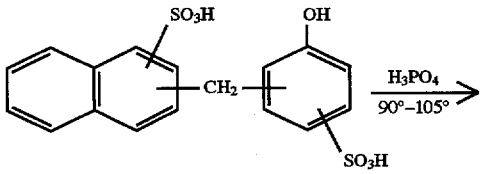

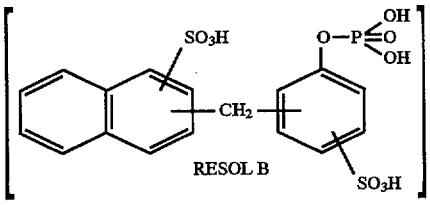

In the foregoing reaction the ratio of naphthalene sulfonic acid to phenol is, in weight percent, 1 to 40 percent naphthalene sulfonic acid to 60 to 99 percent phenol.

Where phenol alone is used without naphthalene sulfonic acid the phosphated structure should be

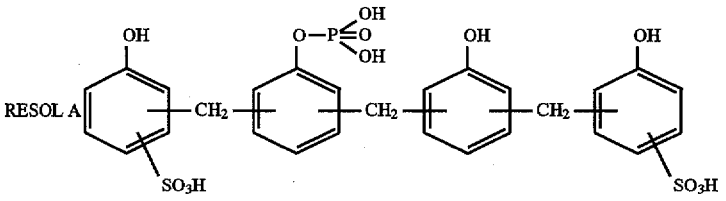

Additional structures that may be obtained during the reactions are as follows:

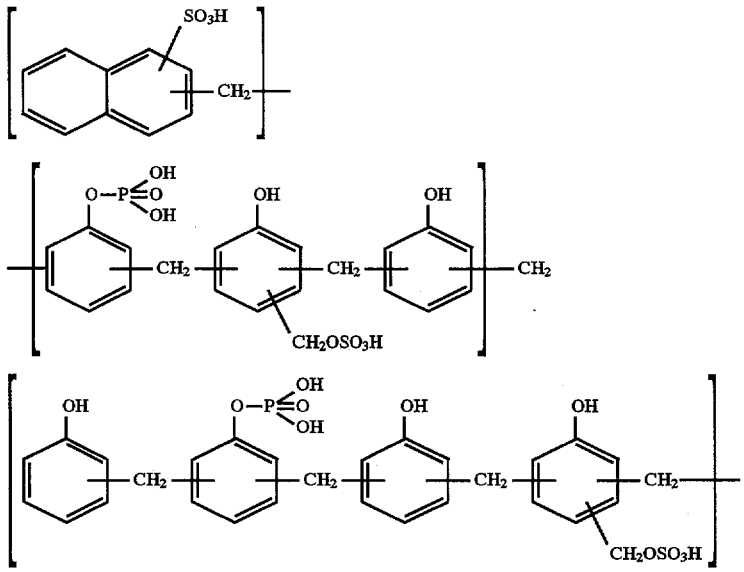

The present invention provides fibrous polyamide substrates, which exhibit improved resistance to stain by acid colorants after washing with detergent, that have had applied thereto a composition comprising a partially phosphated, partially sulfonated resol resin and a methacrylic polymer or copolymer or combinations thereof including polymethacrylic acid and polymethylmethacrylate, as well as copolymers based on methacrylic acid and a comonomer, and methylmethacrylate and a comonomer. The combination may also include fluorochemical.

Methacrylate monomers include methacrylic acid and its esters, for example, methylmethacrylate. Thus the polymer may be, for example, polymethacrylic acid or polymethylmethacrylate. Suitable comonomers for the methacrylate copolymers include monocarboxylic acids, polycarboxylic acids, carboxylic acid anhydrides, esters or amides of carboxylic acids, nitriles, vinylidene monomers and olefinic monomers. By way of example there may be mentioned alkyl acrylates wherein the alkyl moiety has 1 to 4 carbon atoms, itaconic acid, sodium sulfostyrene and sulfated castor oil. An especially preferred comonomer is acrylic acid.

Suitably the polymer or copolymer contains 30 to 100 weight percent of methacrylic acid or methylmethacrylate and preferably more than 60%, by weight, of methacrylic acid.

It has been found that especially good results are achieved employing a treating solution consisting essentially of the sulfonated, phosphated resol resin and a methacrylic acid polymer or copolymer of high weight average molecular weight and high number average molecular weight.

The methacrylic acid polymer or copolymer may suitably have a weight average molecular weight of 2,000 to 500,000, but preferably has a high weight average molecular weight above 140,000, and more preferably above 150,000 and up to 170,000. The methacrylic acid polymer or copolymer has a high number average molecular weight of 20,000 to 40,000, preferably 25,000 to 35,000, more preferably 30,000 to 35,000; and a molecular size M.Z. suitably of 200,000 to 600,000.

It was surprising that polymers of high weight average (M.W.) and number average (M.N.) molecular weight would provide good results, especially in the light of the teachings of U.S. Pat. No. 4,937,123 and the commercial products based on methacrylic polymers and copolymers described in U.S. Pat. No. 4,937,123. In the latter U.S. Patent the polymers and copolymers of methacrylic acid which gave acceptable results all had relatively low weight average and number average molecular weights; furthermore, the commercial Leukotan (Trade Mark of Rohm & Haas) metacrylic acid-based polymer described in the U.S. patent also had low weight average and number average molecular weights. In the methacrylic acid-based polymers in the Examples of the U.S. Patent, polymer D in Table 3 of the patent, with a number average molecular weight of 3,430, and polymer C with a weight average molecular weight of 85,500 represent the highest values for polymers considered to provide satisfactory results.

The present invention employs methacrylic polymers or copolymers of significantly higher M.N., and preferably significantly higher M.W. than those methacrylic polymers and copolymers particularly taught to be useful in U.S. Pat. No. 4,937,123.

Generally the resol products of this invention are applied to the polyamide substrate from an aqueous solution at a pH below 5 after the dyeing process. The resol products may be applied from an aqueous exhaust bath or by continuous application methods such as padding, foam, flooding or spray; all of which are well known to those skilled in the art.

Fluorochemical compositions provide oil, water and soil repellency and thus can be applied in conjunction with the resol products of this invention.

Methacrylic polymers including polymethacrylic acid and polymethylmethacrylates may also be applied in conjunction with the resol resins of this invention to further reduce or eliminate any likelihood of initial yellowing or of discoloration upon exposure to light or discoloration upon exposure to oxides of nitrogen.

The resole resin is applied in an amount of at least 0.1 to 5.0 percent based on the weight of the substrate; and the methacrylic polymer or copolymer is applied in an amount of at least 0.1 to 5.0 percent based on the weight of the substitute.

The treating solution suitably contains at least 0.01 percent, by weight of the resole and at least 0.1 percent, by weight, of the methacrylic polymer or copolymer, based on the weight of the treating solution.

TEST METHODS

In the test procedures and examples described below all percentages are by weight unless otherwise indicated, the molecular weight (M.W.) is the weight average molecular weight, and the molecular weight (M.N.) is the number average molecular weight.

INITIAL STAIN RESISTANCE ("IS")

A 5"×5" sample of the substrate to be tested is placed on a flat, non-absorbent surface. A two inch ring is placed on the sample and 20 ml of staining solution is poured into the ring and worked into the substrate. The ring is removed and the sample is left undisturbed for 24 hours at ambient temperature. The staining solution is prepared by dissolving 45 grams of cherry flavoured KOOL AID (Trade Mark), which contains Acid Red Dye No. 40 sugar-sweetened in 500 ml of water at 20° C. After 24 hours the sample is rinsed with cool tap water and dried.

The stain resistance of the sample is visually rated by assessing the amount of color remaining in the stained area by comparison with the unstained portion. The sample is rated on a scale from 1 to 8 wherein 8 is excellent stain resistance and 1 is poor stain resistance categorized as follows:

8=excelent stain resistance,

7=good stain resistance,

6=poor stain resistance,

5=unacceptable staining,

4=unacceptable staining,

3=unacceptable staining,

2=unacceptable staining,

1=unacceptable staining.

AFTER WET CLEANING STAIN RESISTANCE ("W.S.")

The sample to be tested is first immersed in a detergent solution containing 15 grams of DUPONOL WAQE (Trade Mark of E. I. DuPont de Nemours for a Surface active agent based on lauryl sulfate) per litre of water at a pH of 10 and at 20° C. for 15 minutes. The sample is removed from the detergent solution and rinsed thoroughly with cool tap water and dried. The staining solution is then applied and evaluated as set out in the initial stain resistance procedure.

INITIAL YELLOWING (DISCOLORATION) EVALUATION ("ID")

In the examples a graduated scale from 1 to 5 was used to evaluate yellowing where 5 represents no yellowing, 4 represents acceptable yellowing and 3 or less represents unacceptable yellowing.

DISCOLORATION UPON EXPOSURE TO LIGHT ("LD")

In the examples a graduated scale from 1 to 5 was used to evaluate discoloration upon exposure to light where 5 represents no discoloration, 4 represents acceptable discoloration and 3 or less represents unacceptable discoloration. Exposure to light was carried out according to AATCC test methods with an exposure time of 40 standard hours.

The following resol resins A and B where prepared according to the preceding general disclosure for use in examples of this invention:

RESOL A

To a clean tank was added 3 parts by weight of water followed by 1.3 parts by weight of a 45% solution of potassium hydroxide to establish a pH of 9. Molten phenol was added in 18 parts, by weight, the mixture was heated to raise the temperature to 80° C. and a 37% solution of formaldehyde was added slowly in small portions in a total of 15.5 parts by weight.

After the addition of the final portion of the formaldehyde solution, the mixture was heated to raise the temperature slowly to 105°–110° C., and was maintained at this temperature for 60 minutes, then cooled to 70° C. The pH of the thus cooled mixture was adjusted to 6–7 with 1.5 parts by weight of a 56% solution of acetic acid. Sodium metabisulfite was added in an amount of 7.14 parts by weight and the mixture was heated to raise the temperature slowly to 105°–110° C. and was maintained at this temperature for 90 minutes. The mixture was cooled to 70° C. and 2.6 parts by weight of an 85% solution of phosphoric acid was added and the mixture was heated to raise the temperature to 105°–110° C. and was maintained at this temperature for 60 minutes. The mixture was allowed to cool and there was added 46.46 parts by weight of water and 4.5 parts by weight of 45% caustic potash solution to establish a pH of 4–5 and the resole resin was recovered from the aqueous mix. The above parts by weight are to a total of 100 parts.

RESOL B

The same procedure was followed as for Resol A but employing the following amounts by weight, sequentially, to a total of 100 parts and employing molten phenol and naphthalene monosulfonate in place of the molten phenol of Resole A.

3% water 1.4% 45% potassium hydroxide solution

16% molten phenol

2% naphthalene monosulfonate 14.6% 37% formaldehyde solution 1.5% acetic acid 6.3% sodium metabisulfite 2.38% phosphoric acid 48.32% water 4.5% 45% caustic potash solution.

Resol resins A and B combined with methacrylic polymers used in examples of this invention are of the following composition, in which the molecular weight (M.W.) are weight average molecular weights.

Resol 'A'/Acrylic "A"—55% by weight Resol A combined with 45% by weight methacrylic, polymer of 250,000 to 5000,00 M.W.

Resol 'A'/Acrylic "B"—55% by weight Resol A combined with 45% by weight methacrylic polymer of 40,000 to 80,000 M.W.

Resol 'A'/Acrylic "C"—55% by weight Resol A combined with 45% by weight methacrylic polymer of 2,000 to 10,000 M.W.

Resol 'A'/Acrylic "D"—55% by weight Resol A combined with 15% by weight methacrylic polymer of 250,000 to 500,000 M.W.

30% by weight methacrylic polymer of 2,000 to 10,000 M.W.

15% by weight methacrylic polymer of 2,000 to 10,000 M.W.

Resol 'B'/Acrylic "A"—55% by weight Resol B combined with 45% by weight methacrylic polymer of 250,000 to 500,000 M.W.

Resol 'B'/Acrylic "B"—55% by weight Resol B combined with 45% by weight methacrylic polymer of 40,000 to 80,000 M.W.

Resol 'B'/Acrylic "C"—55% by weight Resol B combined with 45% by weight methacrylic polymer of 2,000 to 10,000 M.W.

Resol 'B'/Acrylic "D"—55% by weight Resol B combined with 15% by weight methacrylic polymer of 250,000 to 500,000 M.W.

30% by weight methacrylic polymer of 2,000 to 10,000 M.W.

Commercially available stain resist products used for comparison with the products of the present invention are designated as follows:

Comparative stain resist A—FX661: a novolak, acrylic blend available from 3M Co.

Comparative stain resist B—FX369: a novolak resin available from 3M.

Comparative stain resist C—Algard DP3 4694: a novolak resin available from Allied Colloids Inc.

The nylon 6 and 66 substrates used in examples of this invention were in cut pile carpet form that was processed through a dyeing cycle without dyestuffs being present so as to yield an uncolored substrate free of fibre lubricating oils. These substrates are designated as follows:

Nylon 66—Monsanto fibre type 1837; moist heat set

Nylon 6—BASF fibre, moist heat set.

EXAMPLE 1

A treating solution was prepared containing 2.0% resol A based on the nylon 66 sample weight of 15 grams and exhausted onto the fibre at a liquor ratio of 15:1, at a pH of 2.5 and at 75° C. for a period of 20 minutes. The sample was then rinsed and dried.

EXAMPLE 2

A treating solution was prepared containing 4.0% resol A based on the nylon 6 sample weight of 15 grams and exhausted onto the fibre at a liquor ratio of 15:1 at a pH of 2.5 and at 75° C. for a period of 20 minutes. The sample was rinsed and dried.

EXAMPLE 3

A nylon 66 sample was prepared as in Example 1 except that 2.0% of resol B replaced resol A.

EXAMPLE 4

A nylon 6 sample was prepared as in Example 2 except that 4% of resol B replaced resol A.

EXAMPLE 5

A nylon 66 sample was prepared as in Example 1 except that 2% comparative stain resist B replaced resol A.

EXAMPLE 6

A nylon 6 sample was prepared as in Example 2 except 4% comparative stain resist B replaced resol A.

EXAMPLE 7

A nylon 66 sample was prepared as in Example 1 except that 2% comparative stain resist C replaced resol A.

EXAMPLE 8

A nylon 6 sample was prepared as in Example 2 except that 4% comparative sample C replaced resol A.

Examples 1 through 8 were evaluated for initial stain resistance (IS) after wet cleaning stain resistance (WS), initial discoloration (ID) and discoloration upon exposure to light (LD), the results being set forth in Table I.

TABLE 1

| Example | I.S. | W.S. | I.D. | L.D. |
|---|---|---|---|---|
| 1 | 8 | 7 | 3–4 | 3 |
| 2 | 8 | 7 | 3 | 3 |
| 3 | 8 | 7 | 3–4 | 3–4 |
| 4 | 8 | 6 | 3–4 | 3 |
| 5 | 8 | 6 | 3–4 | 3 |
| 6 | 8 | 5 | 3 | 2–3 |
| 7 | 7 | 5 | 4–5 | 4–5 |
| 6 | 4 | 4 | 4 | |

As can be seen from the data in Table 1, the polyamide substrates treated with resol resins of this invention (Examples 1 to 4) generally demonstrate a higher initial stain resistance and stain resistance after wet cleaning than comparative novolak resins (Examples 5 to 8). It is also apparent that certain novolak resins, although demonstrating inferior to unacceptable stain resistance, do exhibit less discoloration initially and upon exposure to light (Examples 7 and 8).

EXAMPLE 9

A treating solution was prepared containing 4.0% resol A/Acrylic A blend based on a nylon 6 sample weight of 15 grams and exhausted onto the fibre at a liquor ratio of 15:1 at a pH of 2.5 and at a temperature of 75° C. for a period of 20 minutes. The sample was rinsed and dried.

In Examples 10 through 17, nylon 6 samples were prepared and treated as in Example 9 except the stain resist compounds used were as set forth in Table 2.

TABLE 2

| Example | Stain Resist Compound |
|---|---|
| 10 | Resol 'A'/Acrylic 'B' |
| 11 | Resol 'A'/Acrylic 'C' |
| 12 | Resol 'A'/Acrylic 'D' |
| 13 | Resol 'B'/Acrylic 'A' |
| 14 | Resol 'B'/Acrylic 'B' |
| 15 | Resol 'B'/Acrylic 'C' |
| 16 | Resol 'B'/Acrylic 'D' |
| 17 | Comparative stain resist A. |

Examples 9 through 17 were evaluated for initial stain resistance, after wet cleaning stain resistance, initial discoloration, discoloration upon exposure to light and oxides of nitrogen, the results being set forth in Table 3.

TABLE 3

| Example | I.S. | W.S. | I.D. | L.D. |
|---|---|---|---|---|
| 9 | 8 | 5 | 5 | 5 |
| 10 | 8 | 5 | 5 | 5 |
| 11 | 8 | 5–6 | 5 | 4–5 |
| 12 | 8 | 5 | 5 | 5 |
| 13 | 8 | 4 | 5 | 5 |
| 14 | 8 | 5 | 5 | 5 |
| 15 | 8 | 5 | 5 | 4–5 |
| 16 | 8 | 5 | 5 | 5 |
| 17 | 8 | 4 | 5 | 4–5 |

As can be seen from the data in Table 3, the polyamide substrate treated with resol resins of this invention combined with methacrylic polymers (Examples 9 to 16) demonstrate significant improvements in initial discoloration and discoloration upon exposure to light when compared to the uncombined resol resins of Examples 1 to 4. It is also apparent that resol resins combined with methacrylic polymers of this invention (Examples 9 to 16) exhibit lower stain resistance ratings after wet cleaning as compared to the uncombined resol resins of Examples 1 to 4. Resol resins of this invention combined with methacrylic polymers in Examples 9 through 16 in all examples demonstrate superior or equal properties to comparative sample #17 which is a novolak resin combined with acrylic polymer.

Examples 18 and 19 resol resin A was combined with methacrylic polymer blends as follows:

EXAMPLE 18

Resol 'A'/Acrylic "E"—25% by weight resol "A" combined with

25% by weight methacrylic polymer of 250,000 to 500,000 M.W.;

25% by weight methacrylic polymer of 40,000 to 80,000 M.W.; and

25% by weight methacrylic polymer of 2,000 to 10,000 M.W.

EXAMPLE 19

Resol 'A'/Acrylic "F"—70% by weight resol "A" combined with

10% by weight methacrylic polymer of 250,000to 500,000 M.W.;

10% by weight methacrylic polymer of 40,000 to 80,000 M.W.; and

10% by weight methacrylic polymer of 2,000 to 10,000 M.W.

In Example 18, a treating solution was prepared containing 4.0% resol 'A'/acrylic "E" blend, as previously described, based on a nylon 6 sample weight of 15 grams and exhausted onto the fibre at a liquor ratio of 15:1 at a pH of 2.5 and at a temperature of 75° C for a period of 20 minutes, the sample was rinsed and dried.

Example 19 was prepared and treated as in Example 18 except the stain resistant Resol 'A'/acrylic "F" blend as previously described was used to replace stain resistant Resol 'A'/acrylic "E" blend.

Examples 18 and 19 were tested and reported in Table 4 along with data from Examples 2, 12 and 17 for comparative purposes.

TABLE 4

| Example | I.S. | W.S. | I.D. | L.D. |
|---|---|---|---|---|
| 18 | 8 | 4–5 | 5 | 5 |
| 19 | 8 | 6–7 | 5 | 4–5 |
| 2 | 8 | 7 | 3 | 3 |
| 12 | 8 | 5 | 5 | 5 |
| 17 | 8 | 4 | 5 | 4–5 |

As can be seen from the data in Table 4, the polyamide substrates of Examples 18, 19 and 12 treated with Resol resin containing various proportions of methacrylic polymers of blended molecular weights exhibited superior stain resistance after wet cleaning when compared to the novolak/acrylic of comparative Example 17 and inferior stain resistance after wet cleaning when compared to 100% Resol "A" of Example 2. Furthermore the blended resol/acrylics of Examples 12 and 18 exhibited superior performance upon exposure to nitrous oxides when compared with the comparative novolak/acrylic blend of Example 17. It is also noted that when the proportion of methacrylic polymer present in the resol resin is approximately a ratio of 1:1 as in Example 12 optimum results are obtained with respect to stain resistance after wet cleaning, initial discoloration and discoloration upon exposure to light and oxides when compared to comparative Example 17.

Comparisons of Examples 2, 12, 18 and 19 demonstrate that as the concentration of resol resin to methacrylic polymer is reduced a) the stain resistance after wet cleaning is reduced and b) the propensity for discoloration from tested sources is also reduced.

EXAMPLE 20

A treating solution containing 75 g/L. Resol 'A'/Acrylic 'D' blend and 50 g/L Milease F15N (Trade Mark), a non ionic fluorochemical available from I.C.I., U.S.A. plus 20 g/L. Alkafoam D (Trade Mark), a foaming agent available from Alkaril Chemicals, Inc., and having a pH of 4 using acetic acid was prepared and foamed onto a sample of nylon 66 carpet using a blow ratio of 60:1 and a wet pick up of 20% to provide an application rate of 1.5% Resol 'A'/Acrylic 'D' plus 1% fluorochemical based on the weight of the sample. The sample was dried at 120° C. for 20 minutes. The treated sample was tested with results as set forth in Table 5 along with results from Example 12 Resol 'A'/Acrylic 'D' without fluorochemical.

TABLE 5

| Example | I.S. | W.S. | I.D. | L.D. |
|---|---|---|---|---|
| 18 | 8 | 6 | 5 | 5 |
| 12 | 8 | 5 | 5 | 5 |

Example 18 containing Resol 'A'/Acrylic 'D' and a fluorochemical demonstrated no adverse affects due to the presence of fluorochemical when compared with Example 12 which did not contain a fluorochemical. It should be noted that less stain resistant chemical is required when directly applied to the substrate via foam methods, when compared to indirect application via exhaust methods.

EXAMPLE 21

A treating solution containing 75 g/L Resol resin B and 50 g/l of Milease F15N (Trade Mark) a non ionic fluorochemical available from I.C.I., U.S.A. plus 20 g/L Alkafoam D (Trade Mark), a foaming agent available from Alkaril Chemicals and having a pH of 4 using acetic acid was prepared and foamed onto a sample of nylon 66 carpet using a blow ratio of 60:1 and a wet pick up of 20% to provide an application rate of 1.5% resol resin 'B' plus 1% fluorochemical based on the weight of the sample. The sample was dried at 120° C. for 20 minutes. The treated sample was tested with results as set forth in Table 6 along with results from Example 3 Resol 'B' containing no fluorochemical.

TABLE 6

| Example | I.S. | W.S. | I.D. | L.D. |
|---|---|---|---|---|
| 21 | 8 | 7 | 3–4 | 3–4 |
| 3 | 8 | 7 | 3–4 | 3–4 |

Example 21 containing Resol 'B' resin and a fluorochemical demonstrated no adverse affects due to the presence of a fluorochemical when compared with Example 3 containing only Resol Resin 'B'. It should be noted that less stain resist chemical is required when directly applied to the substrate via foam methods when compared to indirect application via exhaust methods.

EXAMPLE 22

A treating solution was formed containing:

0.4 g/l resol A (40% solids)

0.3 g/l condensation product of sulfonated naphthalene and formaldehyde (40% solids);

1.5 g/l methacrylic resin (15% solids) having M.W. above 150,000 and M.N. above 30,000.

The solution was adjusted to pH 2 with phosphoric acid and sulfuric acid and was applied on a 10 g sample of Nylon 6 carpet with a pick up of 350%. The sample was steamed for 3 minutes, rinsed and dried. Test results for the resulting dried sample are shown in Table 7.

TABLE 7

| I.S. | W.S. | I.D. | L.D. |
|---|---|---|---|
| 8 | 7 | 5 | 4–5 |

The condensation product of the sulfonated naphthol and formaldehyde is a dispersant and improves solubility of the resins.

Table 7 shows that surprisingly good results were achieved in all test categories for employing the methacrylic resin of high M.W. and M.N.

The methacrylic resin employed is a copolymer of methacrylic acid and acrylic acid.

EXAMPLE 23

A treating solution was formed containing:

0.2 g/l resol A (40% solids)

0.15 g/l condensation product of sulfonated naphthalene and formaldehyde (40% solids);

1.0 g/l methacrylic resin (15% solids) having M.W. above 150,000 and M.N. above 30,000

3 g/l magnesium sulfate.

The solution was adjusted to pH 2 with a combination of phosphoric acid and sulfuric acid and was applied on a 10 g sample of Nylon 66 carpet with a pick up of 350%. The thus treated sample was steamed for 3 minutes, rinsed and dried. Test results for the dried sample are set out in Table 8.

TABLE 8

| I.S. | W.S. | I.D. | L.D. |
|---|---|---|---|
| 8 | 7 | 5 | 4–5 |

The results are consistent with the good results achieved in Example 22.

The treated samples in Examples 22 and 23 were also shown to display superior durability to washing or wash fastness.

In this specification, unless indicated otherwise the molecular weights (M.W.) are weight average molecular weights; and the % are % by weight unless indicated otherwise.

I claim:

1. A fibrous polyamide substrate having durable resistance to staining by acid colorants, the substrate having applied thereto a treating solution comprising a sulfonated, phosphated resol resin and a methacrylic polymer or copolymer having a number average molecular weight in the range of 20,000 to 40,000.

2. The substrate according to claim 1, wherein said treating solution consists essentially of said resin and said methacrylic polymer or copolymer, said polymer or copolymer being selected from the group consisting of homopolymers and copolymers having a weight average molecular weight within the range of 100,000 to 500,000.

3. The substrate according to claim 2, wherein said homopolymer or copolymer has a molecular size M.Z. of 200,000 to 600,000, and a weight average molecular weight above 140,000.

4. The substrate according to claim 2 wherein said polymer or copolymer consists essentially of a copolymer of methacrylic acid and acrylic acid having a weight average molecular weight of 150,000 to 170,000 and a number average molecular weight of 25,000 to 35,000.

5. The substrate according to claim 4, wherein the resol resin is a condensation product of an aldehyde, phenol and a sulfonated naphthalene.

6. The substrate according to claim 4, wherein the resol resin is a condensation product of formaldehyde and a substance selected from the group consisting of: a phenol and a phenol in admixture with a sulfonated naphthalene.

7. The substrate according to claim 6, the resol resin being the phenol formaldehyde condensation product, the phenol being both sulfonated and phosphated.

8. A substrate according to claim 7, wherein said solution consists essentially of said resin, said polymer or copolymer i) and a fluorochemical providing oil, water and soil repellence.

9. The substrate according to claim 6, wherein the resol resin is a condensation product of a formaldehyde and a phenol in admixture with a sulfonated naphthalene, the phenol being phosphated.

10. The substrate according to claim 4, wherein said polymer or copolymer has a number average molecular weight of 30,000 to 35,000.

11. The substrate according to claim 2, wherein the substrate material is a polyamide, the resol resin being present in an amount of at least 0.1 to 5.0 percent and the polymer or copolymer being present in an amount of at least 0.1 to 5.0 percent, the said percentages being based on the weight of the substrate.

12. The substrate according to claim 2, wherein said resin contains phenol units having a degree of phosphation of 1 to 15%, by weight.

13. The substrate according to claim 2, wherein said polymer or copolymer has a number average molecular weight of 25,000 to 35,000.

14. A method of treating a fibrous polyamide substrate, to render it durably resistant to staining by acid colorants comprising: applying to the substrate material a solution comprising a sulfonated, phosphated resol resin and a methacrylic polymer or copolymer having a number average molecular weight in the range of 20,000 to 40,000.

15. A method according to claim 14, wherein said solution consists essentially of said resin and said methacrylic polymer or copolymer, said polymer of copolymer being selected from the group consisting of homopolymers and copolymers having a weight average molecular weight within the range of 100,000 to 500,000.

16. A method according to claim 15, wherein said polymer or copolymer consists essentially of a copolymer or methacrylic acid and acrylic acid having a weight average molecular weight of 150,000 to 170,000 and a number average molecular weight of 25,000 to 35,000.

17. A method according to claim 16, wherein said polymer or copolymer has a number average molecular weight of 30,000 to 35,000.

18. A method according to claim 15, wherein said polymer or copolymer has a number average molecular weight of 25,000 to 35,000.

19.The method according to claim 15, the resol resin being a formaldehyde condensation product of phenol and a sulfonated naphthalene, in which the phenol is phosphated.

20. The method according to claim 19, said solution containing the resol resin to provide an amount of at least 0.1 to 5.0 percent based on the weight of the substrate, and said methacrylic polymer or copolymer i).in an amount of 0.1 to 5.0 percent, based on the weight of the substrate.

* * * * *